US006045957A

United States Patent [19]

Takeshima et al.

[11] Patent Number: 6,045,957

[45] Date of Patent: Apr. 4, 2000

[54] PHOTOCONDUCTOR FOR ELECTROPHOTOGRAPHY

[75] Inventors: Motohiro Takeshima; Haruo Kawakami, both of Nagano, Japan

[73] Assignee: Fuji Electric Co., Ltd., Japan

[21] Appl. No.: 09/368,818

[22] Filed: Aug. 5, 1999

[30] Foreign Application Priority Data

Aug. 6, 1998 [JP] Japan ..... 10-223219

[51] Int. Cl.[7] ..... G03G 5/047

[52] U.S. Cl. ..... 430/58.05; 430/58.4

[58] Field of Search ..... 430/58.05, 58.4

[56] References Cited

U.S. PATENT DOCUMENTS 3,997,342 12/1976 Bailey ..... 96/1.6
4,556,621 12/1985 Hottmann et al. ..... 430/58.05

*Primary Examiner*—John Goodrow
*Attorney, Agent, or Firm*—Morrison Law Firm

[57] ABSTRACT

A metal carboxylate of the following general Formula (I), (II), or (III),

Formula (I)

Formula (II)

Formula (III)

wherein $Ar_1$ represents an optionally substituted arylene group, $Ar_2$ represents one of the group consisting of an alkyl group, an optionally substituted aryl group, an aralkyl group, and a hydrogen atom, X represents a metal atom selected from the group consisting of tin, zinc, cobalt, nickel, iron, and chromium, and n represents the valence of X, is added to the charge transport layer of a photoconductor for electrophotography. The resulting photoconductor exhibits excellent electric stability in repetitive use with little variation in electrically charged potential or residual potential.

18 Claims, 1 Drawing Sheet

PHOTOCONDUCTOR FOR ELECTROPHOTOGRAPHY

BACKGROUND OF THE INVENTION

The present invention relates to a photoconductor for electrophotography. More specifically, the present invention relates to a photoconductor for electrophotography useful in printers, copiers, and the like, having improved additives in an organic charge transport layer. Even more specifically, the present invention provides a photoconductor having a small variation in the charged potential between the initial charged potential and the charged potential after repeated use. The present invention further provides a photoconductor having a small variation in the residual potential between the initial residual potential and the residual potential after repeated use.

A photoconductor for electrophotography, hereinafter also referred to as simply a photoconductor, has a photoconductive layer formed on a conductive substrate. An organic photoconductor, which employs charge-generating or charge-transporting organic compounds for the photoconductive layer, has been researched and developed in recent years. The organic photoconductor has been applied to the fields of copying, printing, and the like, taking advantage of the variety, high productivity, and safety of the organic material.

The organic photoconductor has several functions in electrophotography. The organic photoconductor must maintain a surface charge in darkness, receive light and generate carriers, and transport the generated carriers. The organic photoconductor is classified in two categories, either a single-layered type, or a function-separated multi-layered type. The organic photoconductor of the single-layered type has a photoconductive layer performing all the above functions. The function-separated, multi-layered photoconductor has a photoconductive layer consisting of a charge generation layer and a charge transport layer. The charge generation layer generates charges on exposure to light. The charge transport layer preserves surface charges in darkness. Additionally, the charge transport layer transports the charges generated in the charge generation layer on exposure to light.

Recently, the function-separated, multi-layered organic photoconductor has been chiefly used in the field of electrophotography. The photoconductive layer of the function-separated and multi-layered organic photoconductor consists of a charge generation layer and a charge transport layer. Applying a coating liquid to a conductive substrate forms the charge generation layer. The coating liquid for the charge generation layer is prepared by dispersing charge-generating organic pigment and a resin binder in an organic solvent. Applying a second coating liquid forms the charge transport layer. The coating liquid for the charge transport layer is prepared by dissolving charge-transporting low molecular weight organic compound and a resin binder in an organic solvent.

The properties of a conventional organic photoconductor, however, do not necessarily satisfy all the specified demands. Some of the above stated properties have a strong opportunity for improvement. For example, the property of electric stability in repetitive use has significant room for improvement over the current technology. The repeated and continuous use of a conventional photoconductor in an actual machine causes a variation in electrically charged potential or residual potential, resulting in a deteriorated printing quality.

A factor contributing to this potential variation is accumulation of the generated carriers in the organic photoconductive layer upon light exposure or charge erasing. More specifically, it is believed that the accumulation of the generated carriers originates from the trapping of carriers in the charge generation layer, in the charge transport layer, or at the interface of the two. Another factor is deterioration of the organic material, attributable to radiation, heat, and ozone generated during repetitive use of the photoconductor in an actual machine. Other environmental factors, such as changes in temperature or humidity contribute to the deterioration of the organic material of the photoconductor. Charge-generating materials and charge transporting materials have been recently positively improved. However, neither the means nor the materials have been found by which this problem can be adequately solved.

Moreover, the incorporation of conventional additives to the charge transport layer does not increase the stability of electrically charged potential and residual potential when the photoconductor is used repeatedly. The incorporation of some of the additives to the charge transport layer actually causes a negative effect, decreasing charged potential or increasing residual potential.

OBJECTS AND SUMMARY OF THE INVENTION

It is an object of the present invention to provide an organic photoconductor which overcomes the foregoing problems.

It is another object of the present invention to provide an organic photoconductor having small variation in electrically charged potential and residual potential after repeated use.

It is a further object of the present invention to provide an organic photoconductor having excellent image characteristics.

A thorough research of additives has shown that the incorporation of a specific metal carboxylate to the charge transport layer is very effective for attaining the objects of the present invention. Incorporation of a specific metal carboxylate keeps a charged potential and a residual potential unchanged after repetitive use, without degrading other electric performances. The invention is effective in various combinations of charge generation layers and charge transport layers.

A first photoconductor of the present invention comprises a conductive substrate, an under-coating layer, and a photoconductive layer laminated successively on the conductive substrate. The photoconductive layer consists of the charge generation layer and the charge transport layer. The charge transport layer is formed on the charge generation layer. In addition, the charge transport layer contains a metal carboxylate represented by the following general formula (I), Formula (I)

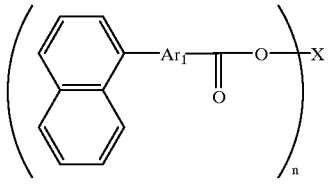

wherein $Ar_1$ represents an optionally substituted arylene group, X represents a metal atom selected from the group consisting of tin, zinc, cobalt, nickel, iron, and chromium, and n represents the valence of metal atom X.

A second photoconductor of the present invention comprises a charge transport layer containing a metal carboxylate represented by the following general formula (II), Formula (II)

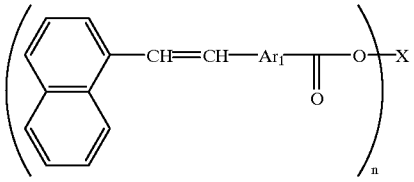

wherein $Ar_1$, n, and X represent the same functionality as previously described. The carboxylate ligand carries a skeleton stilbenyl group, in place of the metal carboxylate represented by the general formula (I) in the previously described first photoconductor.

A third photoconductor comprises a charge transport layer containing a metal carboxylate represented by the following general formula (III), Formula (III)

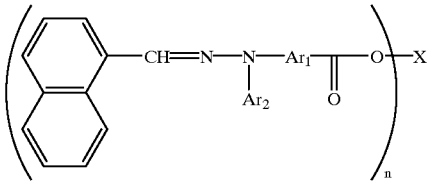

wherein $Ar_1$, n, and X represent thc same functionality as those referred to in the first photoconductor, $Ar_2$ represents an alkyl group, an optionally substituted aryl group, an arylalkyl group, or a hydrogen atom. The carboxylate ligand carries a skeleton hydrazonyl group, in place of the metal carboxylate represented by the general formula (I) of the previously described first photoconductor.

Briefly stated, the present invention provides a metal carboxylate of the following general Formula (I), (II), or (III), Formula (I)

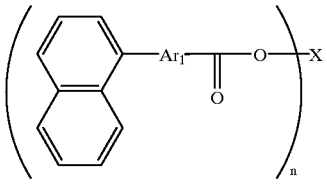

Formula (II)

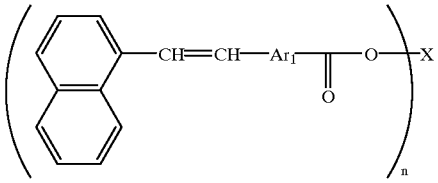

-continued

Formula (III)

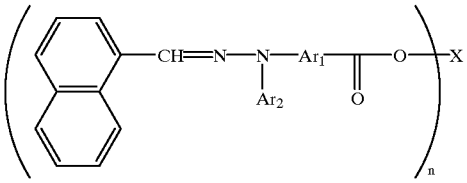

wherein $Ar_1$ represents an optionally substituted arylene group, $Ar_{r2}$ represents one of the group consisting of an alkyl group, an optionally substituted aryl group, an aralkyl group, and a hydrogen atom, X represents a metal atom selected from the group consisting of tin, zinc, cobalt, nickel, iron, and chromium, and n represents the valence of X, being added to the charge transport layer of a photoconductor for electrophotography. The resulting photoconductor exhibits excellent electric stability in repetitive use with little variation in electrically charged potential or residual potential.

The above, and other objects, features and advantages of the present invention will become apparent from the following description read in conjunction with the accompanying drawing, in which like reference numerals designate the same elements.

DETAILED DESCRIPTION OF THE INVENTION

Figure 1:
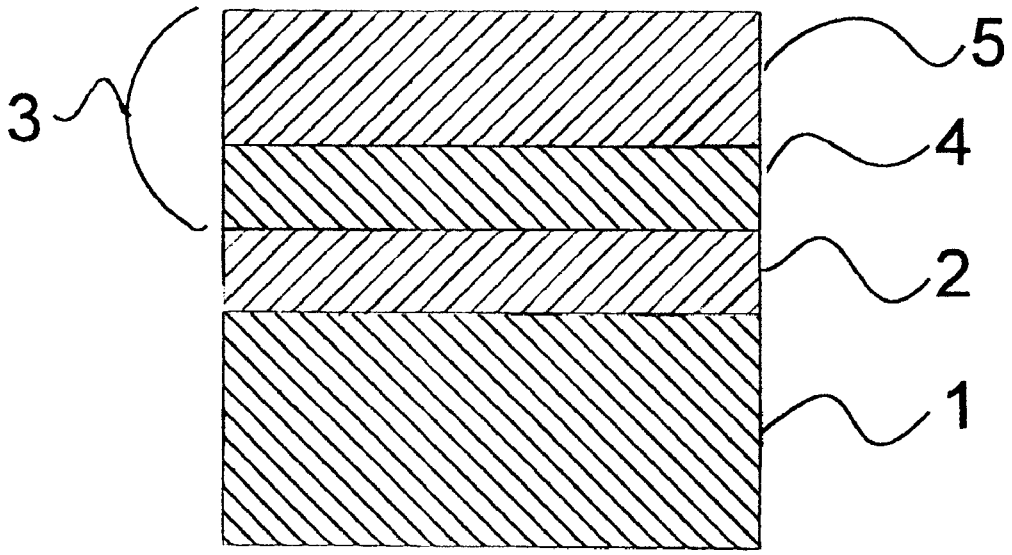
FIG. 1 is a schematic cross section of a function-separated, multi-layered type photoconductor.

Referring to FIG. 1, a schematic cross section of a preferred embodiment of the photoconductor of the invention is depicted. The photoconductor is preferably a negatively charged, function-separated, multi-layered type photoconductor. The photoconductor includes an under-coating layer 2 coated on a conductive substrate 1. A photoconductive layer 3, on the under-coating layer 2, includes a charge generation layer 4 and a charge transport layer 5 successively formed thereon.

Conductive substrate 1 is both one of the electrodes of the photoconductor, and a supporting body for each of the layers that compose the photoconductor. Conductive substrate 1 is preferably a cylinder, a plate, or a film. The preferred materials of conductive substrate 1 include glass and resin that are surface-treated with conductive materials, and metals, such as aluminum, stainless steel, and nickel.

Under-coating layer 2, consisting of a metal oxide film, such as anodized aluminum, or a resinous layer, is formed if required. Under-coating layer 2 controls the injection of charge from conductive substrate 1 to photoconductive layer 3. Moreover, under-coating layer 2 coats any defects on the surface of conductive substance 1, while improving adhesiveness of photoconductive layer 3 to conductive substrate 2.

The resin used for under-coating layer 2 includes an insulating polymer, such as casein, polyvinyl alcohol, polyamide, melamine, and cellulose, and a conductive polymer, such as polythiophene, polypyrrole, and polyaniline. A plurality of these resins may be used for under-coating layer 2. Moreover, these resins may contain a metal oxide, such as titanium dioxide and zinc oxide.

Vacuum-depositing an organic photoconductive material as a charge generating material is a preferred method to form charge generation layer 4. Alternatively, charge generation layer 4 is formed by applying a coating liquid dispersed with particles of an organic photoconductive material and a dissolved resin binder.

Irradiating charge generation layer 4 generates carriers. It is necessary that the generation and the injection of carriers to charge transport layer 5 are efficient. The injection of carriers is preferably conducted with a small dependence on electric field. It is preferable that the injection of carriers to charge transport layer 5 is accomplished even with a minimal electric field.

Charge-generating materials include phthalocyanine compounds, such as metal-free phthalocyanine and titanylphthalocyanine. Another class of charge-generating materials include azo compounds, including bisazo compounds. Further charge-generating materials include pigments and dyes, such as quinone, indigo, cyanin, squarylium, azulenium, and pyrylium compounds.

The resin binder includes polyester resin, polyvinyl acetate resin, polyacrylate resin, polymethacrylate resin, polycarbonate resin, polyvinyl-acetoacetal resin, polyvinylpropional resin, polyvinyl-butylal resin, phenoxy resin, epoxy resin, polyurethane resin, cellulose ester resin, and cellulose ether resin. A combination of the above resin can also be employed to create a suitable resin binder.

Five to 500 parts by weight of charge-generating material is used with respect to ten parts by weight of resin binder. The preferable range of the charge-generating material is from 10 to 100 parts by weight with respect to ten parts by weight of resin binder. The thickness of charge generation layer 4 is generally equal to or less than 5 $\mu$m, preferably less than 1 $\mu$m.

Charge transport layer 5 includes a charge-transporting material, a resin binder, and a metal carboxylate represented by the following general formula (I), (II) or (III), Formula (I)

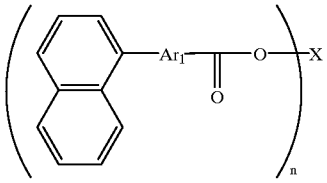

Formula (II)

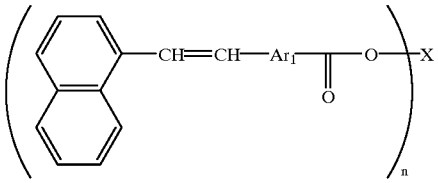

Formula (III)

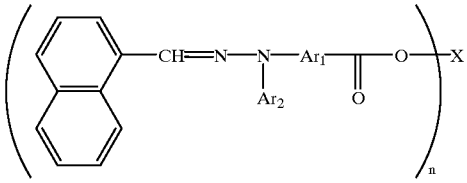

wherein $Ar_1$ represents an optionally substituted arylene group, X represents a metal atom selected from the group consisting of tin, zinc, cobalt, nickel, iron, and chromium, n represents the valence of metal atom X, $Ar_2$ represents an optionally substituted alkyl group, an optionally substituted aryl group, an optionally substituted arylalkyl group, or a hydrogen atom.

Preferred $Ar_1$ groups include a phenylene group, a naphthylene group, and an anthrylene group, each of which may be substituted. Preferred substituents of $Ar_1$ include an alkyl (group, an aryl group, a hydroxy group, a halogen atom, an alkoxy group an aryloxy group an alkylcarbonyl group, an arylcarbonyl group, an alkoxycarbonyl group, an aryloxycarbonyl group, a carboxy group, and a cyano group.

Preferred $Ar_2$ groups include a $C_1$–$C_3$ alkyl group, and a phenyl group, each of which may be further substituted. Preferred substituents of the $Ar_2$ group include a $C_1$–$C_3$ alkyl group and a hydroxy group.

The following structures exemplify the embodiments of the metal carboxylate represented by the general formula (I), (II) or (III) where metal atom X is zinc. The metal atom X is not limited to zinc. Tin, cobalt, nickel, iron or chromium can also be used in place of zinc.

The metal carboxylate of the general formula (I) is exemplified in formulae (I-1) to (I-9). The metal carboxylate of the general formula (II) is exemplified in formulae (II-1) to (II-9). The metal carboxylate of the general formula (III) is exemplified in formulae (III-1) to (III-27).

(I-1)

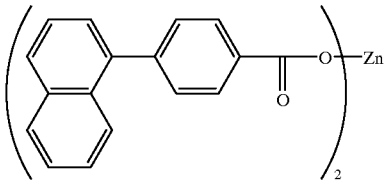

(I-2)

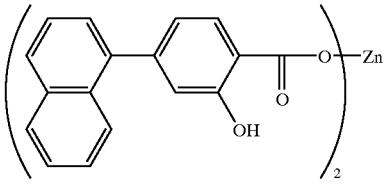

(I-3)

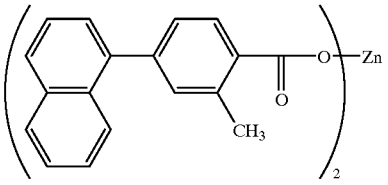

(I-4)

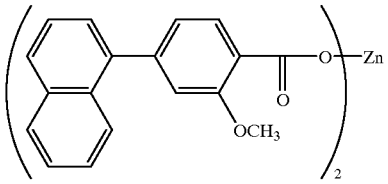

(I-5)

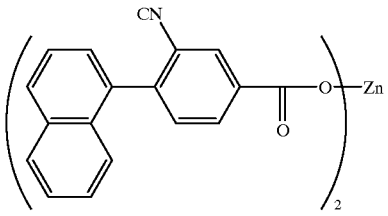

-continued
(I-6)
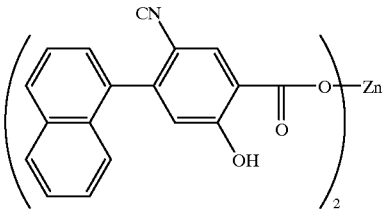
(I-7)
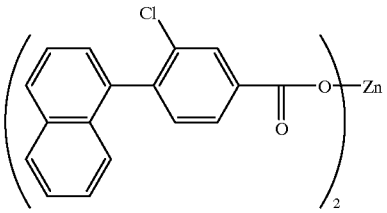
(I-8)
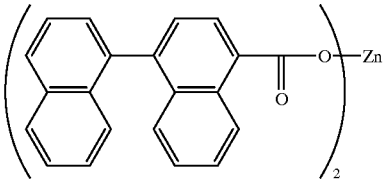
(I-9)
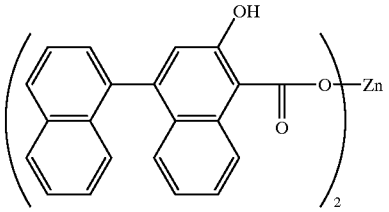
(II-1)
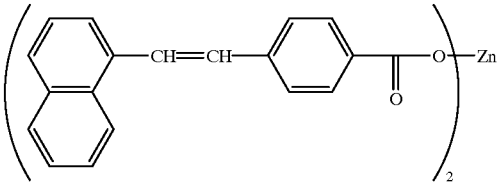
(II-2)
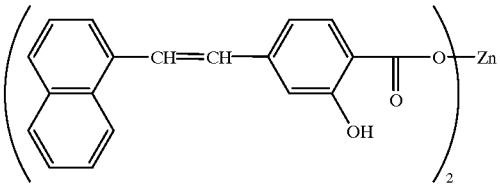
(II-3)
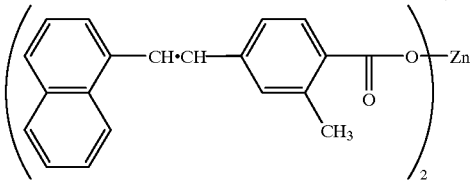
-continued
(II-4)
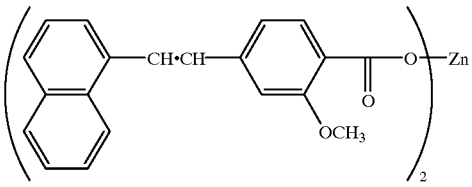
(II-5)
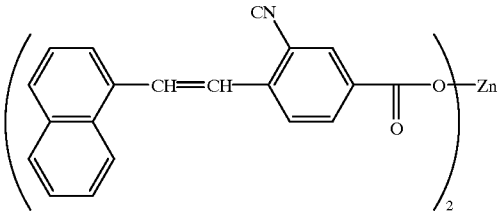
(II-6)
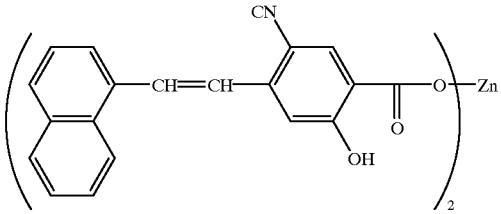
(II-7)
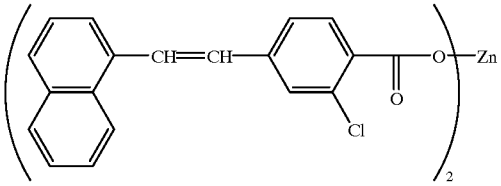
(II-8)
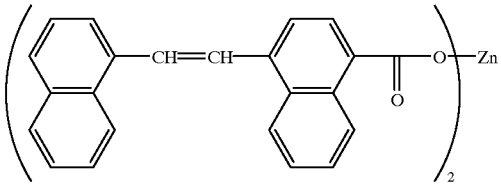
(II-9)
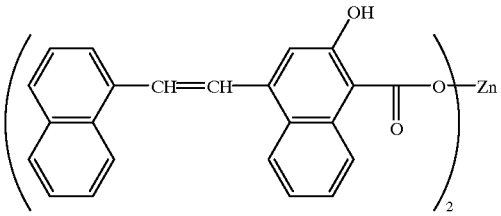
(III-1)
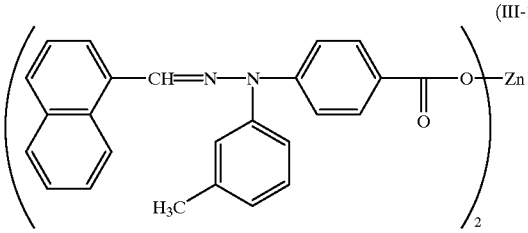

-continued
(III-2)
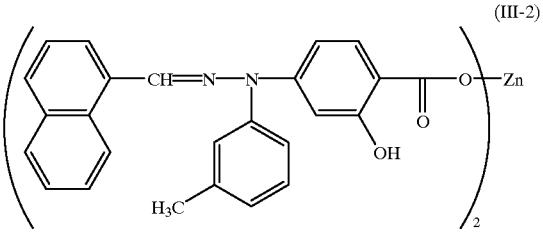
(III-3)
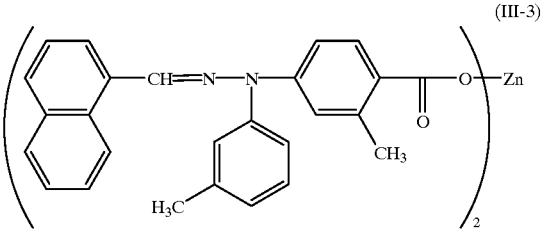
(III-4)
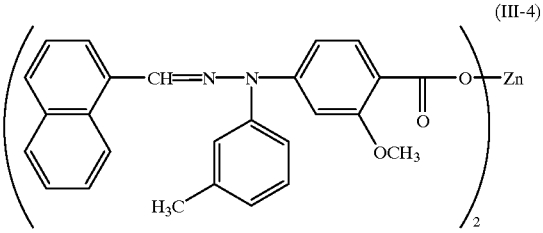
(III-5)
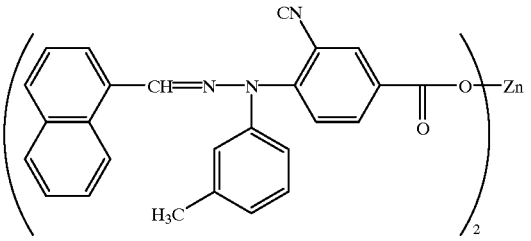
(III-6)
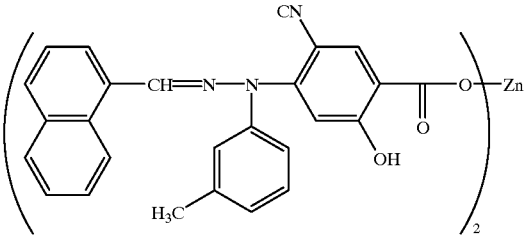
(III-7)
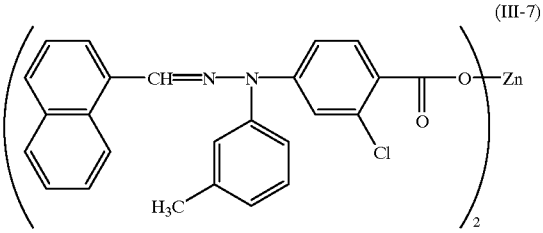
-continued
(III-8)
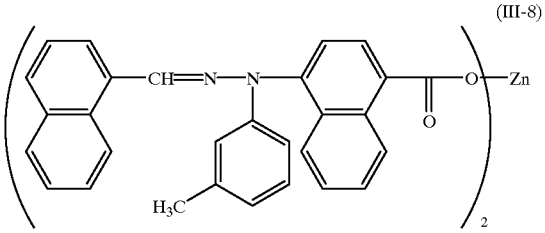
(III-9)
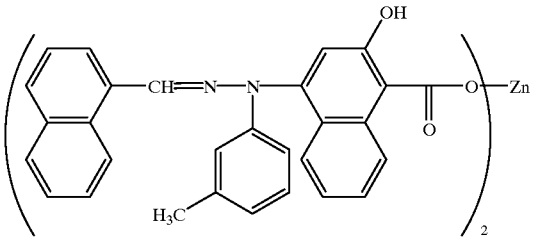
(III-10)
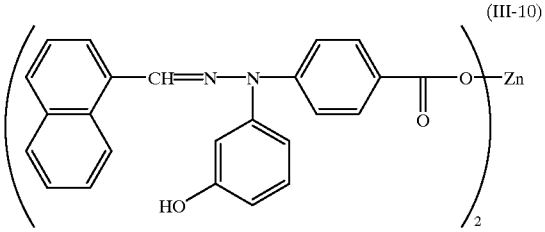
(III-11)
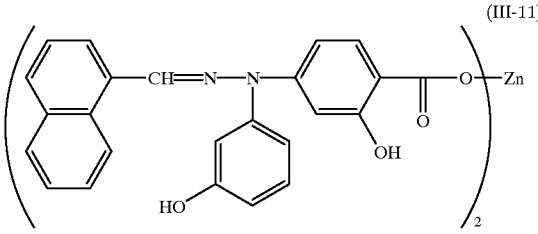
(III-12)
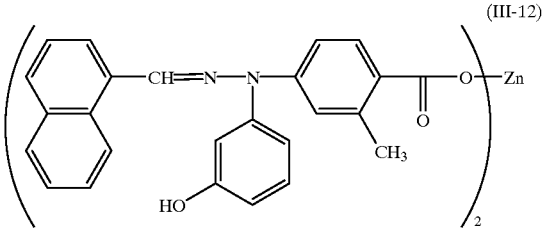
(III-13)
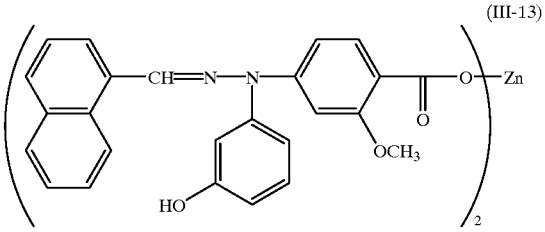
(III-14)
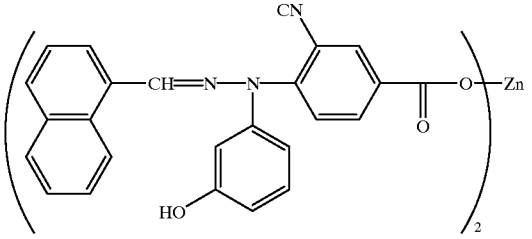

-continued
(III-15)
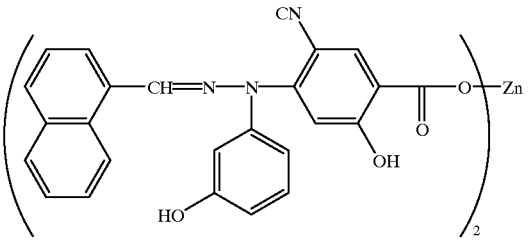
(III-16)
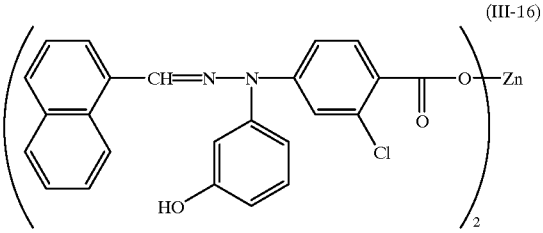
(III-17)
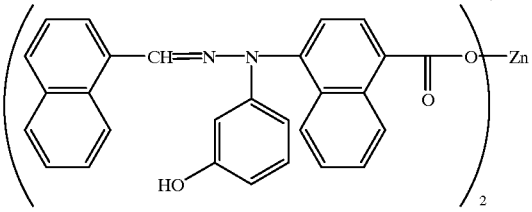
(III-18)
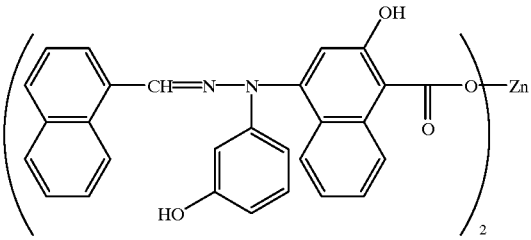
(III-19)
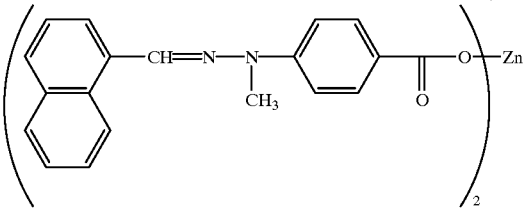
(III-20)
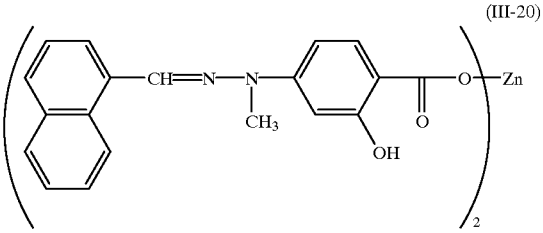
(III-21)
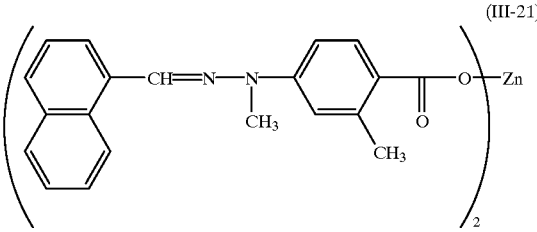
-continued
(III-22)
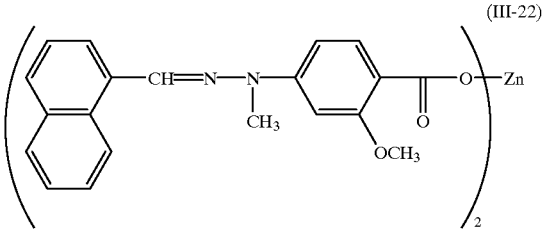
(III-23)
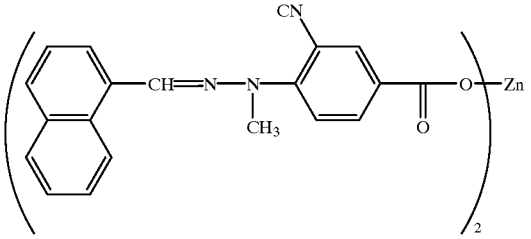
(III-24)
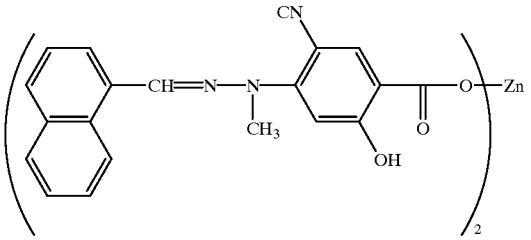
(III-25)
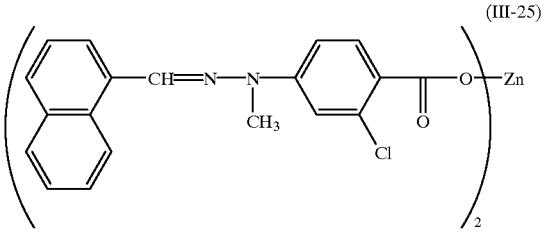
(III-26)
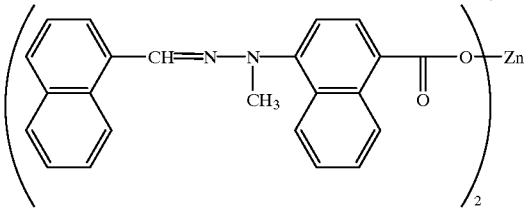
(III-27)
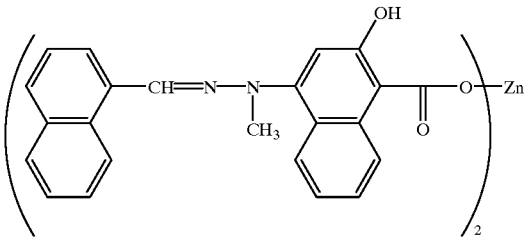
The charge-transporting material preferably includes at least one of a hydrazone compound, a butadiene compound, a diamine compound, an indole compound, an indoline compound, a stilbene compound, and a distilbene compound.

The resin binder preferably includes at least one of a polycarbonate resin, such as a bisphenol A type, a bisphenol Z type, and a bisphenol A type-biphenyl copolymer, a polystyrene resin, and a polyphenylene resin.

Two to fifty parts by weight of the charge-transporting material is preferably used with respect to 100 parts by weight of the resin binder. A more preferably amount of the charge-transporting material is 3 to 30 parts by weight with respect to 100 parts by weight of the resin binder. The film thickness of charge transport layer 5 is in the range of 3$\mu$ to 50 $\mu$m to preserve practically effective surface potential. Preferably, the film thickness of charge transport layer 5 is between 15 $\mu$m to 40 $\mu$m.

Preferably, 0.01 to 10 parts by weight of the metal carboxylate with respect to 100 parts by weight of the resin binder is incorporated into charge transport layer 5. More preferably, 0.1 to 3 parts by weight of the metal carboxylate with respect to 100 parts by weight of the resin binder is incorporated into charge transport layer 5.

In addition, an electron-accepting material, an antioxidant or a photostabilizer, may be incorporated into under-coating layer 2 and charge transport layer 5 to provide improved sensitivity, decreased residual potential, resistance to environment, and stability to harmful radiation. Such materials include a chroman derivative, such as tocopherol, an ether, an ester, a polyarylalkane compound, a hydroquinone derivative, a diether, benzophenone derivative, a benzotriazole derivative, a thioether, a phenylenediamine derivative, a phosphonate ester, a phosphite ester, a phenol, a hindered phenol, a straight-chain amine compound, a cyclic amine compound, and a hindered amine compound.

Additionally, a silicone oil or a fluorocarbon oil, is preferably incorporated into photoconductive layer 3 to facilitate flattening of the formed film by providing sufficient lubrication to the film surface.

Furthermore, a surface protective layer is optionally formed on photoconductive layer 3. The surface protective layer provides photoconductive layer 3 with resistance to environmental stresses as well as improved mechanical strength. The surface protective layer is composed of a material having resistance to mechanical and environmental stress. The material of the surface protective layer is chosen such that light, to which charge generation layer 4 is sensitive, penetrates with minimal loss in the surface protective layer.

EXAMPLES

The following examples describe embodiments of the present invention.

Example 1

An aluminum cylinder was used as a conductive substrate. A first coating liquid was dip-coated to the outer surface of the cylinder, and dried at a temperature of 100° C. for 30 minutes. An under-coating layer of about 3 $\mu$m thick was formed.

A first coating liquid was prepared as follows. Five parts by weight of alcohol soluble polyamide resin (CM8000 made by Toray Industries, Inc.) were dissolved in 90 parts by weight of methanol. Five parts by weight of titania corpuscles treated with aminosilane were dispersed in the methanol solution.

A second coating liquid was dip-coated on the under-coating layer and dried at a temperature of 80° C. for 30 minutes. A charge generation layer of about 0.3 $\mu$m thick was formed.

The second coating liquid was prepared as follows. One part by weight of phthalocyanine, as a charge generating material, was dispersed and 1.5 parts by weight of polyvinyl-butylal resin, as a resin binder, was dissolved in 60 parts by weight of dichloromethane. Phthalocyanine, represented by the following formula (A), coordinates with oxytitanium. The polyvinyl-butylal resin employed was "S-LEC KS-1" made by Sekisui Chemical Co., Ltd.

Formula (A)

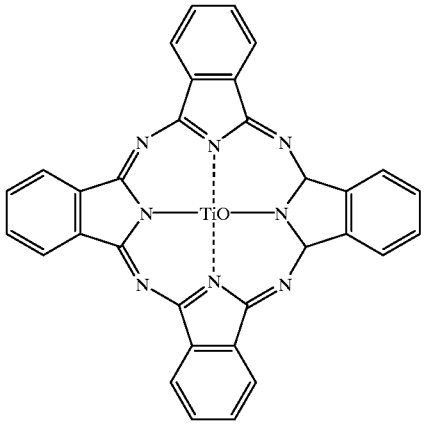

A third coating liquid was applied on the charge generation layer and dried for 60 minutes at a temperature of 90° C., providing a charge transport layer having a thickness of 35 $\mu$m. The third coating liquid was prepared by dissolving a charge-transporting material, and a zinc carboxylate in a solvent. The charge-transporting material was 90 parts by weight of the stilbene compound represented by the following Formula (B). The resin binder was 110 parts by weight of polycarbonate resin TOUGHZET B-500 made by Idemitsu Kosan Co. Ltd. The zinc carboxylate was 0.1 parts by weight of the carboxylate represented by the Formula (I-1). The solvent was 925 parts by weight of dichloromethane. Thus, the organic photoconductor of Example 1 was manufactured.

Formula (B)

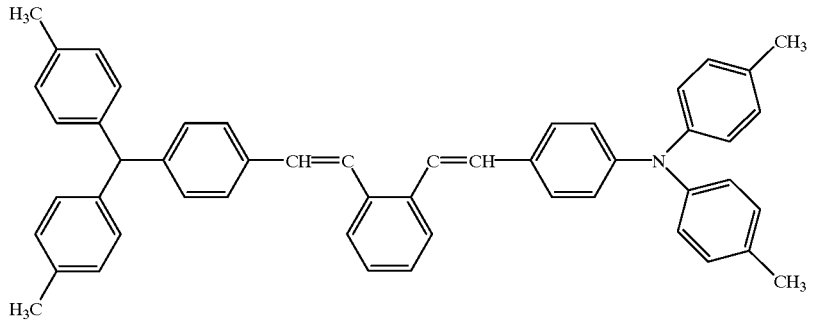

Example 2

The photoconductor of Example 2 was prepared in the same way as that of Example 1 except that the zinc carboxylate of Formula (II-1) was used in place of that represented by Formula (I-1) in the Example 1. The zinc carboxylate of Formula (II-1) carries a skeleton stilbenyl group in the carboxylate ligand.

Example 3

The photoconductor of Example 3 was prepared in the same way as that of Example 1 except that the zinc carboxylate of Formula (III-1) was used in place of that represented by Formula (I-1) in Example 1. The zinc carboxylate of Formula (III-1) carries a skeleton hydrazonyl group in the carboxylate ligand.

Example 4

The photoconductor of Example 4 was prepared in the same way as that of Example 1 except that the zinc carboxylate of Formula (III-10) was used in place of that represented by Formula (I-1) in Example 1. The zinc carboxylate of Formula (III-10) carries a skeleton hydrazonyl group in the carboxylate ligand.

Example 5

The photoconductor of Example 5 was prepared in the same way as that of Example 1 except that the zinc carboxylate of Formula (III-19) was used in place of that represented by Formula (I-1) in Example 1. The zinc carboxylate of Formula (III-19) carries a skeleton hydrazonyl group in the carboxylate ligand.

Example 6

The photoconductor of Example 6 was prepared in the same way as that of Example 1 except that the metal atom of the zinc carboxylate represented by Formula (I-1) was replaced by tin.

Example 7

The photoconductor of Example 7 was prepared in the same way as that of Example 1 except that the metal atom of the zinc carboxylate represented by Formula (I-1) was replaced by cobalt.

Example 8

The photoconductor of Example 8 was prepared in the same way as that of Example 1 except that the metal atom of the zinc carboxylate represented by Formula (I-1) was replaced by nickel.

Example 9

The photoconductor of Example 9 was prepared in the same way as that of Example 1 except that the metal atom of the zinc carboxylate represented by Formula (I-1) was replaced by iron.

Example 10

The photoconductor of Example 10 was prepared in the same way as that of Example 1 except that the metal atom of the zinc carboxylate represented by Formula (I-1) was replaced by chromium.

Example 11

The photoconductor of Example 11 was prepared in the same way as that of Example 1 except that the charge transporting diamine compound represented by the following Formula (C) was used in place of the stilbene compound represented by Formula (B).

Formula (C)

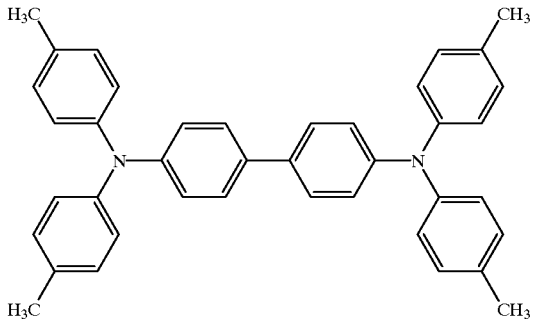

Example 12

The photoconductor of Example 12 was prepared in the same way as that of Example 11 except that the zinc carboxylate of Formula (II-1), carrying a skeleton stilbenyl group in the carboxylate ligand, was used instead of that represented by Formula (I-1).

Example 13

The photoconductor of Example 13 was prepared in the same way as that of Example 11 except that the zinc carboxylate represented by Formula (III-1), carrying a skeleton hydrazonyl group in the carboxylate ligand, was used instead of that represented by Formula (I-1).

Example 14

The photoconductor of Example 14 was prepared in the same way as that of Example 11 except that the zinc carboxylate represented by Formula (III-10), carrying a skeleton hydrazonyl group in the carboxylate ligand, was used instead of that represented by Formula (I-1).

Example 15

The photoconductor of Example 15 was prepared in the same way as that of Example 11 except that the zinc carboxylate represented by Formula (III-19), carrying a skeleton hydrazonyl group in the carboxylate ligand, was used in place of that represented by Formula (I-1).

Example 16

The photoconductor of Example 16 was prepared in the same way as that of Example 11 except that the metal atom in the zinc carboxylate represented by Formula (I-1) was replaced by a tin atom.

Example 17

The photoconductor of Example 17 was prepared in the same way as that of Example 11 except that the metal atom in the zinc carboxylate represented by Formula (I-1) was replaced by a cobalt atom.

Example 18

The photoconductor of Example 18 was prepared in the same way as that of Example 11 except that the metal atom in the zinc carboxylate represented by Formula (I-1) was replaced by a nickel atom.

Example 19

The photoconductor of Example 19 was prepared in the same way as that of Example 11 except that the metal atom in the zinc carboxylate represented by Formula (I-1) was replaced by an iron atom.

Example 20

The photoconductor of Example 20 was prepared in the same way as that of Example 11 except that the metal atom in the zinc carboxylate represented by Formula (I-1) was replaced by a chromium atom.

Comparative Example 1

The photoconductor of Comparative Example 1 was prepared in the same way as that in Example 1 except that the metal carboxylate was not incorporated into the charge transport layer.

Comparative Example 2

The photoconductor of Comparative Example 2 was prepared in the same way as that in Example 11 except that the metal carboxylate was not incorporated into the charge transport layer.

Evaluation of the Photoconductor

The following describes the evaluation of electric characteristics of the photoconductor of examples 1 to 20, and comparative examples 1 to 2.

The photoconductor was rotated and electrically charged to a potential of −650 V in darkness. The surface potential of the photoconductor, five seconds after halting rotation and charging, was measured. This measurement gives the retention rate of charged potential after five seconds, $R_5$. Then, the surface of the photoconductor was subjected to continuous exposure to light. The potential-halving exposure $E_{1/2}$, which is the amount of exposure light energy required to attenuate potential from −600 V to −300 V, was measured.

Residual potential Vr, which is surface potential of the photoconductor exposed to a total amount of light energy of 5 $\mu J/cm^2$, was measured.

In addition, the photoconductor was installed into a laser beam printer remodeled to measure surface potential of the photoconductor. Charged potential, Vi, and residual potential, Vr, at the initial and after 30,000 sheets of printing were measured.

TABLE 1

| | Initial Electric Characteristics | | | Potential in Actual Machine | | | |
|---|---|---|---|---|---|---|---|
| | | | | Initial Use | | After 30,000 printouts | |
| Sample | $R_5$ (%) | $E_{1/2}$ ($\mu$J/cm2) | $V_r$ (−V) | $V_i$ (−V) | $V_r$ (−V) | $V_i$ (−V) | $V_r$ (−V) |
| Ex. 1 | 96 | 0.09 | 32 | 680 | 52 | 668 | 80 |
| Ex. 2 | 95 | 0.09 | 33 | 683 | 50 | 660 | 78 |
| Ex. 3 | 96 | 0.09 | 31 | 685 | 55 | 667 | 90 |
| Ex. 4 | 94 | 0.10 | 30 | 681 | 53 | 668 | 95 |
| Ex. 5 | 95 | 0.10 | 31 | 680 | 52 | 670 | 92 |
| Ex. 6 | 96 | 0.09 | 33 | 685 | 51 | 670 | 90 |
| Ex. 7 | 94 | 0.10 | 32 | 680 | 50 | 669 | 95 |
| Ex. 8 | 95 | 0.10 | 35 | 682 | 53 | 667 | 96 |
| Ex. 9 | 95 | 0.11 | 32 | 683 | 57 | 668 | 90 |
| Ex. 10 | 96 | 0.10 | 33 | 681 | 55 | 670 | 90 |
| Ex. 11 | 96 | 0.11 | 53 | 685 | 73 | 670 | 95 |
| Ex. 12 | 94 | 0.10 | 55 | 680 | 74 | 669 | 93 |
| Ex. 13 | 95 | 0.12 | 57 | 682 | 75 | 667 | 107 |
| Ex. 14 | 95 | 0.11 | 56 | 683 | 73 | 668 | 110 |
| Ex. 15 | 95 | 0.10 | 55 | 681 | 76 | 670 | 105 |
| Ex. 16 | 96 | 0.09 | 54 | 685 | 78 | 670 | 102 |
| Ex. 17 | 94 | 0.10 | 53 | 680 | 76 | 669 | 110 |
| Ex. 18 | 95 | 0.12 | 56 | 682 | 77 | 667 | 107 |
| Ex. 19 | 95 | 0.10 | 55 | 683 | 75 | 668 | 110 |

TABLE 1-continued

| | Initial Electric Characteristics | | | Potential in Actual Machine | | | |
|---|---|---|---|---|---|---|---|
| | | | | Initial Use | | After 30,000 printouts | |
| Sample | $R_5$ (%) | $E_{1/2}$ (μJ/cm2) | $V_r$ (−V) | $V_i$ (−V) | $V_r$ (−V) | $V_i$ (−V) | $V_r$ (−V) |
| Ex. 20 | 95 | 0.10 | 54 | 681 | 77 | 670 | 105 |
| Comp. Ex. 1 | 94 | 0.10 | 35 | 682 | 55 | 640 | 260 |
| Comp. Ex. 2 | 94 | 0.09 | 33 | 683 | 50 | 644 | 266 |

Table 1 indicates that the photoconductor of Examples 1 to 20, which has the metal carboxylate represented by general formulae (I) to (III) incorporated into the charge transport layer, has variation in the charged potential and the residual potential suppressed on repetitive use of the photoconductor. This is compared with the photoconductor of Comparative Examples 1 and 2, which contain no metal carboxylate in the charge transport layer. In Comparative Examples 1 and 2, a large variation in the charged potential and the residual potential is demonstrated.

Incorporating a metal carboxylate into the charge transport layer of the photoconductor shows an excellent effect not only in the photoconductor for a laser beam printer incorporating phthalocyanine compound, but also in the photoconductor for a analog copier, a digital copier, and a facsimile machine.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A photoconductor for electrophotography comprising:

a conductive substrate;

an under-coating layer on said conductive substrate;

a photoconductive layer on said under-coating layer;

said photoconductive layer having a charge generation layer and a charge transport layer; and said charge transport layer having a metal carboxylate represented by the following general Formula (I), Formula (I)

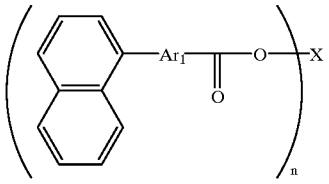

wherein $Ar_1$ represents an optionally substituted arylene group, X represents a metal atom selected from the group consisting of tin, zinc, cobalt, nickel, iron, and chromium, and n represents the valence of X.

2. A photoconductor for electrophotography according to claim 1, wherein:

said charge generation layer is on said under-coating layer; and said charge transport layer is on said charge generation layer.

3. A photoconductor for electrophotography according to claim 1, wherein $Ar_1$ represents an optionally substituted phenyl group.

4. A photoconductor for electrophotography according to claim 1, wherein $Ar_1$ represents an optionally substituted naphthyl group.

5. A photoconductor for electrophotography according to claim 1, wherein said optionally substituted arylene group is substituted with at least one of a halogen, a hydroxy group, a cyano group, a methyl group, and a methoxy group.

6. A photoconductor for electrophotography comprising:

a conductive substrate;

an under-coating layer on said conductive substrate;

a photoconductive layer on said under-coating layer;

said photoconductive layer having a charge generation layer and a charge transport layer; and said charge transport layer having a metal carboxylate represented by the following general Formula (II), Formula (II)

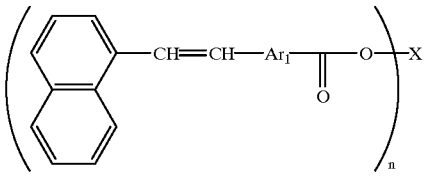

wherein $Ar_1$ represents an optionally substituted arylene group, X represents a metal atom selected from the group consisting of tin, zinc, cobalt, nickel, iron, and chromium, and n represents the valence of X.

7. A photoconductor for electrophotography according to claim 6, wherein:

said charge generation layer is on said under-coating layer; and said charge transport layer is on said charge generation layer.

8. A photoconductor for electrophotography according to claim 6, wherein $Ar_1$ represents an optionally substituted phenyl group.

9. A photoconductor for electrophotography according to claim 6, wherein $Ar_1$ represents an optionally substituted naphthyl group.

10. A photoconductor for electrophotography according to claim 6, wherein said optionally substituted arylene group is substituted with at least one of a halogen, a hydroxy group, a cyano group, a methyl group, and a methoxy group.

11. A photoconductor for electrophotography comprising:

a conductive substrate;

an under-coating layer on said conductive substrate;

a photoconductive layer on said under-coating layer;

said photoconductive layer having a charge generation layer and a charge transport layer; and said charge transport layer having a metal carboxylate represented by the following general Formula (III), Formula (III)

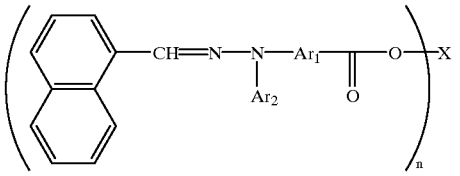

wherein $Ar_1$ represents an optionally substituted arylene group, $Ar_1$ represents one of the group consisting of an alkyl group, an optionally substituted aryl group, an arylalkyl group, and a hydrogen atom, X represents a metal atom selected from the group consisting of tin, zinc, cobalt, nickel, iron, and chromium, and n represents the valence of X.

12. A photoconductor for electrophotography according to claim 11, wherein:

said charge generation layer is on said under-coating layer; and said charge transport layer is on said charge generation layer.

13. A photoconductor for electrophotography according to claim 11, wherein $Ar_1$ represents an optionally substituted phenyl group.

14. A photoconductor for electrophotography according to claim 11, wherein $Ar_1$ represents an optionally substituted naphthyl group.

15. A photoconductor for electrophotography according to claim 11, wherein said optionally substituted arylene group is substituted with at least one of a halogen, a hydroxy group, a cyano group, a methyl group, and a methoxy group.

16. A photoconductor for electrophotography according to claim 11, wherein $Ar_1$ is an optionally substituted phenyl group.

17. A photoconductor for electrophotography according to claim 16, wherein said optionally substituted phenyl group is substituted with at least one of a methyl group and a hydroxy group.

18. A photoconductor for electrophotography according to claim 11, wherein $Ar_2$ is a methyl group.

* * * * *